United States Patent [19]

Kelly, Samuel T. et al.

[11] Patent Number: 4,787,414

[45] Date of Patent: Nov. 29, 1988

[54] FUEL CONTROL VALVE CONSTRUCTION, PARTS THEREFOR AND METHODS OF MAKING THE SAME

[75] Inventors: Kelly, Samuel T., Torrance; Jay R. Katchka, Cypress, both of Calif.

[73] Assignee: Robertshaw Controls Company, Richmond, Va.

[21] Appl. No.: 87,419

[22] Filed: Aug. 20, 1987

Related U.S. Application Data

[62] Division of Ser. No. 938,621, Dec. 5, 1986, Pat. No. 4,729,396.

[51] Int. Cl.[4] ..... F16K 31/06

[52] U.S. Cl. ..... 137/595; 251/129.15

[58] Field of Search ..... 137/595; 251/129.15

[56] References Cited

U.S. PATENT DOCUMENTS

| | | | |
|---|---|---|---|
| 2,991,799 | 7/1961 | Littlefield | 137/595 |
| 3,203,447 | 8/1965 | Bremner et al. | 137/595 |
| 3,472,277 | 10/1969 | Reinicke et al. | 137/595 |
| 3,506,030 | 4/1970 | Vesco | 137/595 |
| 3,661,178 | 5/1972 | Wichmann | 137/595 |
| 4,268,009 | 5/1981 | Allen, Jr. | 251/129.2 |

*Primary Examiner*—Arnold Rosenthal

*Attorney, Agent, or Firm*—Candor, Candor & Tassone

[57] ABSTRACT

A fuel control valve construction, parts therefor and methods of making the same are provided, the construction comprising a housing having an inlet adapted to be interconnected to a fuel source and an outlet adapted to be interconnected to a main burner, the housing having a pilot outlet adapted to be interconnected to a pilot burner for the main burner, the housing having a pilot valve seat and a main valve seat for interconnecting the inlet respectively with the pilot outlet and the main outlet, the housing having a movable pilot valve member for opening and closing the pilot valve seat and a movable main valve member for opening and closing the main valve seat, the housing having a movable lever carrying the pilot valve member and the main valve member and having a manually operable actuator for controlling the operating positions of the lever.

8 Claims, 12 Drawing Sheets

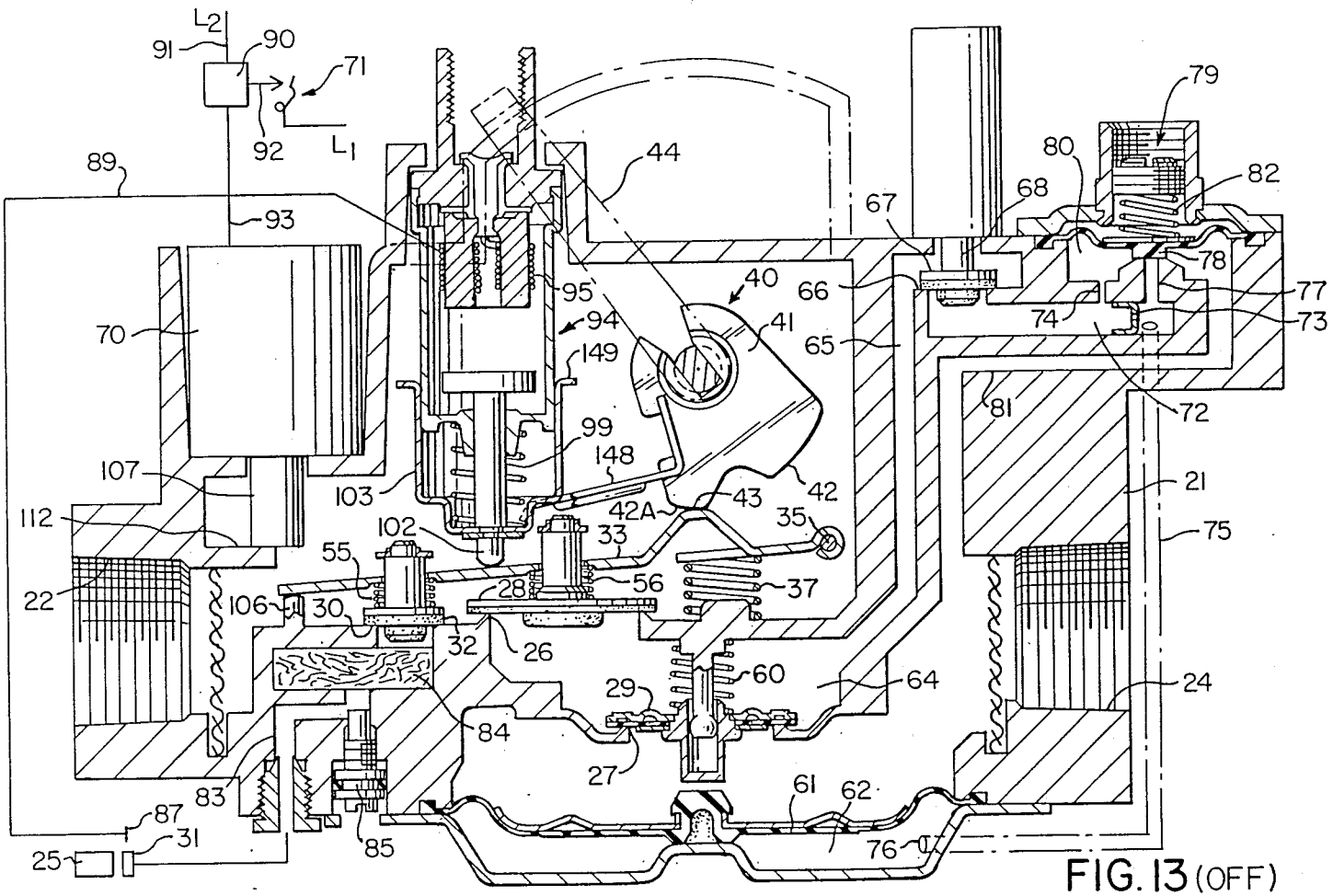
FIG. 13 (OFF)

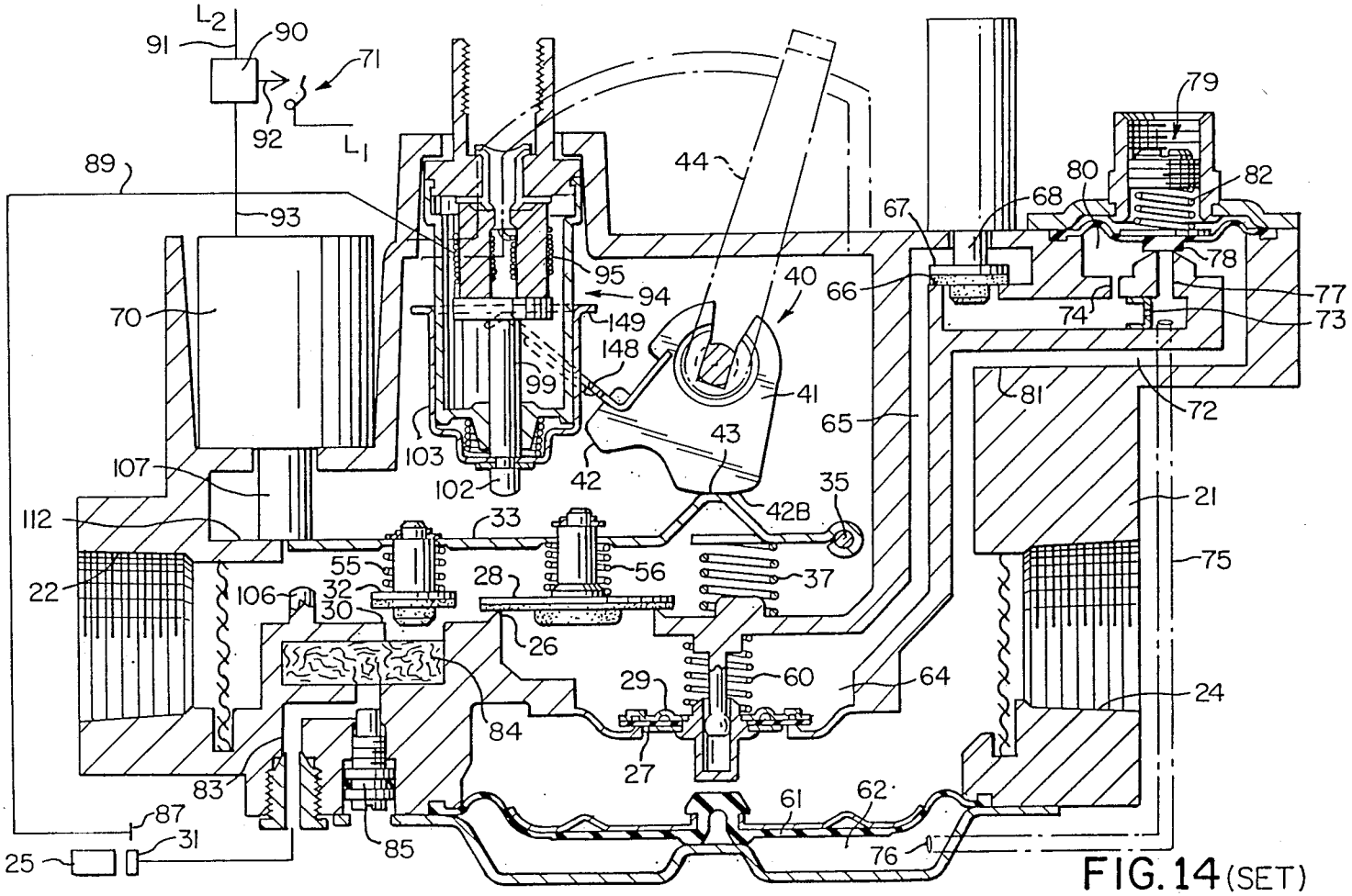
FIG. 14 (SET)

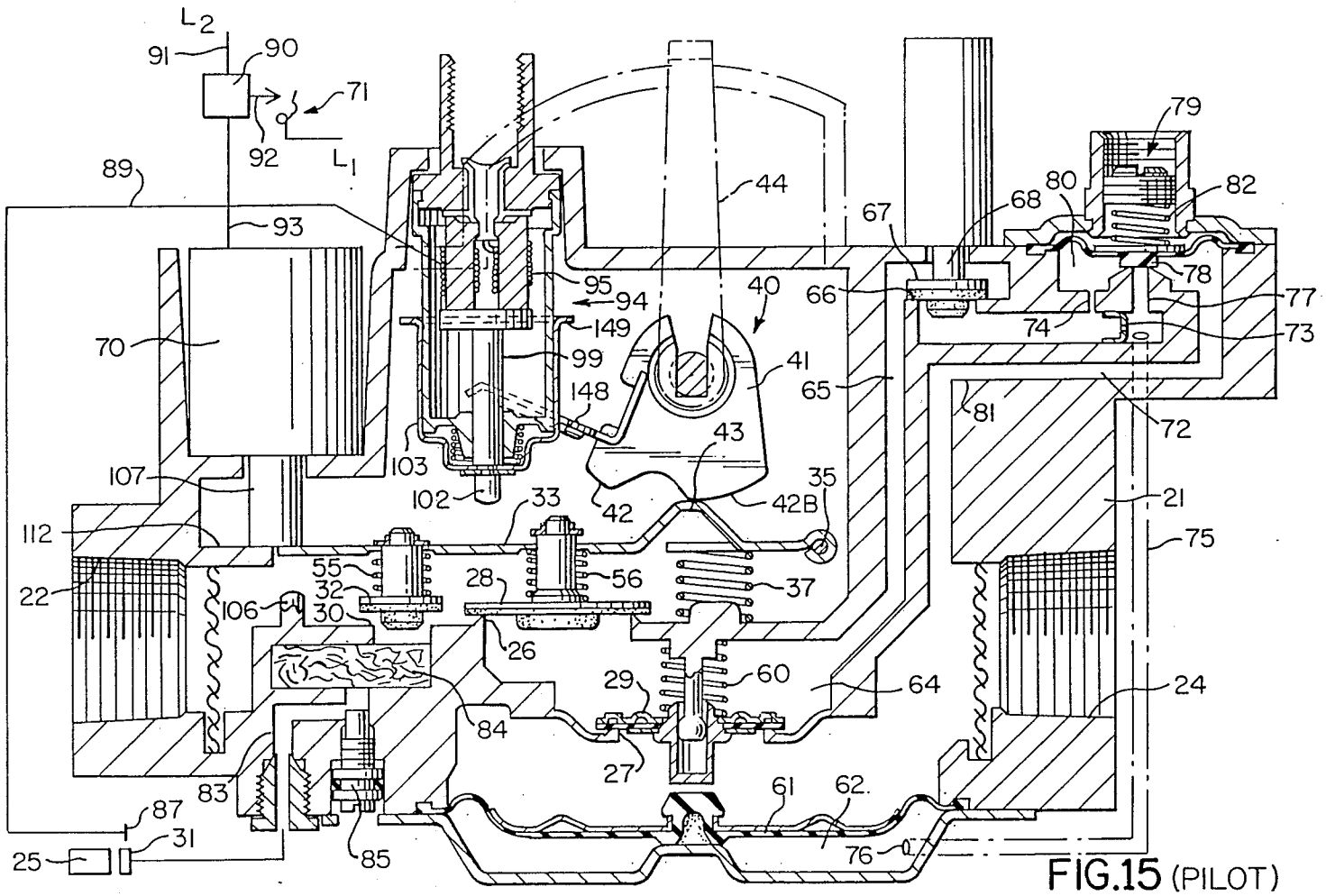
FIG.15 (PILOT)

(ON—THERMOSTAT OFF)

(ON-THERMOSTAT ON)

(ON-FLAME SENSE OFF)

FUEL CONTROL VALVE CONSTRUCTION, PARTS THEREFOR AND METHODS OF MAKING THE SAME

This application is a divisional patent application of its copending parent patent application, Ser. No. 938,621 filed Dec. 5, 1986 now U.S. Pat. No. 4,729,396, dated Mar. 8, 1988.

BACKGROUND OF THE INVENTION

1. Field of the Invention

This invention relates to a new fuel control valve construction and to a method of making the same as well as to new parts for such a fuel control valve construction or the like and to methods of making such parts.

2. Prior Art Statement

It is known to provide a fuel control valve construction comprising a housing means having an inlet means adapted to be interconnected to a fuel source and a main outlet means adapted to be interconnected to a main burner means, the housing means having a pilot outlet means adapted to be interconnected to a pilot burner means for the main burner means, the housing means having a pilot valve seat and a main valve seat for interconnecting the inlet means respectively with the pilot outlet means and the main outlet means, the housing means having a movable pilot valve member for opening and closing the pilot valve seat and a movable main valve member for opening and closing the main valve seat. For example, see the U.S. patent to Kelly, U.S. Pat. No. 4,549,571.

It is also known to provide a combination comprising a supporting means, electrically operated coil means carried by the supporting means, and two movable plunger means carried by the supporting means and being operatively associated with the coil means to be moved to certain positions thereof when the coil means is energized. For example, see the aforementioned patent to Kelly, U.S. Pat. No. 4,549,571.

It is also known to provide a fuel control valve construction comprising a housing means having an inlet means adapted to be interconnected to a fuel source and a main outlet means adapted to be interconnected to a main burner means, the housing means having a pilot outlet means adapted to be interconnected to a pilot burner means for the main burner means, the housing means having a pilot valve seat and a main valve seat for interconnecting the inlet means respectively with the pilot outlet means and the main outlet means, the housing means having a movable pilot valve member for opening and closing the pilot valve seat and a movable main valve member for opening and closing the main valve seat, the housing means having a manually operable actuator means for controlling the operating positions of the valve members, the actuator means having an "off" position wherein both of the valve members are in a closed condition thereof and an "on" position wherein both of the valve members are in an open condition thereof, the actuator means having a "pilot" position wherein the pilot valve member is in an open condition thereof and the main valve member is in a closed condition thereof.

SUMMARY OF THE INVENTION

It is one feature of this invention to provide a new fuel control valve construction having unique means for controlling the pilot valve member and the main valve member thereof.

In particular, it was found according to the teachings of this invention that the pilot valve member and the main valve member can be carried by a single lever movably carried by the fuel control valve housing means and that an actuator means can be carried by the housing means for controlling the operating positions of that lever.

For example, one embodiment of this invention provides a fuel control valve construction comprising a housing means having an inlet means adapted to be interconnected to a fuel source and a main outlet means adapted to be interconnected to a main burner means, the housing means having a pilot outlet means adapted to be interconnected to a pilot burner means for the main burner means, the housing means having a pilot valve seat and a main valve seat for interconnecting the inlet means respectively with the pilot outlet means and the main outlet means, the housing means having a movable pilot valve member for opening and closing the pilot valve seat and a movable main valve member for opening and closing the main valve seat, the housing means having a movable lever carrying the pilot valve member and the main valve member and having a manually operable actuator means for controlling and operating positions of the lever.

It is another feature of this invention to provide a unique coil means and cooperating movable plunger means for such a fuel control valve construction or for other constructions as desired.

In particular, it was found according to the teachings of this invention that a single electrically operated coil can have a portion of one of the plunger means disposed therein wile another plunger means is arranged to be entirely external to that coil while being adapted to be operated by the coil substantially in unison with the plunger means that has the portion thereof disposed in that coil.

For example, one embodiment of this invention provides a combination comprising a supporting means, electrically operated coil means carried by the supporting means, and two movable plunger means carried by the supporting means and being operatively associated with the coil means to be moved to certain positions thereof when the coil means is energized, the coil means comprising a single coil having a portion of one of the plunger means disposed therein, the other of the plunger means being entirely external to the coil while being adapted to be operated by the coil substantially in unison with the one plunger means.

It is another feature of this invention to provide a new fuel control valve construction wherein the actuator means for the pilot valve member and the main valve member thereof operate in a unique manner.

In particular, it was found according to the teachings of this invention that the actuator means for the fuel control valve construction can comprise an arm pivotally mounted to the housing means and being generally movable in a straight line manner while operating the pilot valve member and the main valve member.

For example, one embodiment of this invention provides a fuel control valve construction comprising a housing means having an inlet means adapted to be interconnected to a fuel source and a main outlet means adapted to be interconnected to a main burner means, the housing means having a pilot outlet means adapted to be interconnected to a pilot burner means for the main burner means, the housing means having a pilot valve seat and a main valve seat for interconnecting the inlet means respectively with the pilot outlet means and the main outlet means, the housing means having a movable pilot valve member for opening and closing the pilot valve seat and a movable main valve member for opening and closing the main valve seat, the housing means having a manually operable actuator means for controlling the operating positions of the valve members, the actuator means having an "off" position whereby both of the valve members are in a closed condition thereof and an "on" position wherein both of the valve members are in an open condition thereof, the actuator means having a "pilot" position wherein the pilot valve member is in an open condition thereof and the main valve member is in a closed condition thereof, the actuator means comprising an arm pivotally mounted to the housing means and being generally movable in a straight line manner between the "off" position and the "pilot" position and having the "on" position located intermediate the "off" position and the "pilot" position.

Accordingly, it is an object of this invention to provide a new fuel control valve construction having one or more of the novel features of this invention as set forth above or hereinafter shown or described.

Another object of this invention is to provide a new method of making a fuel control valve construction, the method of this invention having one or more of the novel features of this invention as set forth above or hereinafter shown or described.

Another object of this invention is to provide a new part for such a fuel control valve construction, the new part of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

BRIEF DESCRIPTION OF THE DRAWINGS

FIG. 13 is a schematic view in cross section of the fuel control valve construction of this invention and illustrates the same with the actuator means being disposed in the "off" position thereof.

FIG. 14 is a view similar to FIG. 13 and illustrates the actuator means in the "set" or "pilot light" position thereof.

FIG. 15 is a view similar to FIG. 13 and illustrates the actuator means in the "pilot" position thereof.

DESCRIPTION OF THE PREFERRED EMBODIMENTS

Figure 1:
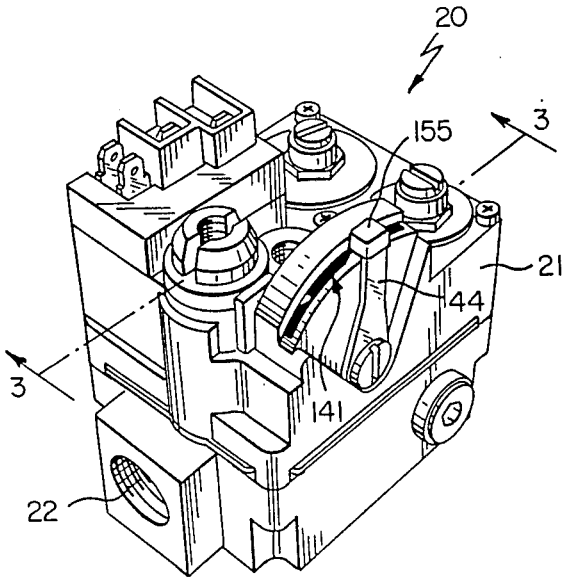
FIG. 1 is a top perspective view of the new fuel control valve construction of this invention.
Figure 2:
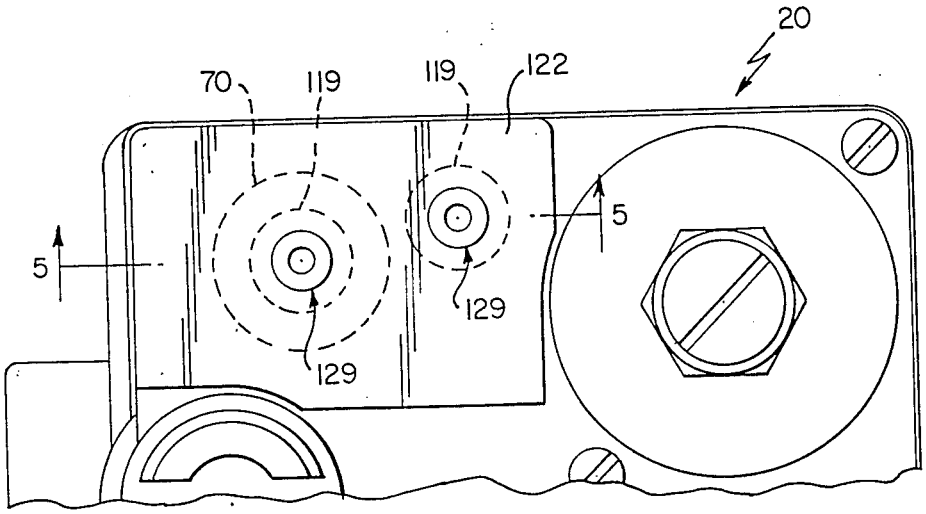
FIG. 2 is an enlarged fragmentary top view of a portion of the fuel control valve construction of FIG. 1 with the electrical housing thereon removed.

While the various features of this invention are hereinafter illustrated and described as being particularly adapted to provide a valve construction for controlling a flow of gaseous fuel, such as natural gas, to a main burner means of a heating apparatus, such as a furnace, water heater, etc., it is to be understood that the various features of this invention can be utilized singly or in various combinations thereof to provide a fuel control valve construction for other apparatus and/or other fuels as desired.

Therefore, this invention is not to be limited to only the embodiments illustrated in the drawings, because the drawings are merely utilized to illustrate one of the wide variety of uses of this invention.

Referring now to FIGS. 1–4, the new fuel control valve construction of this invention is generally indicated by the reference numeral 20 and comprises a housing means 21 formed from a plurality of parts of any suitable material, such as metallic material, and having an inlet means 22 adapted to be interconnected to a source of fuel 23 and an outlet means 24 adapted to be interconnected to a main burner means 25, such as a burner means of a furnace or the like (not shown) when the fuel source 23 is a gaseous fuel source or the like.

The housing means 21 has a first main valve seat 26 disposed between the inlet 22 and outlet 24 and a second main valve seat 27 disposed between the first main valve seat 26 and the outlet 24 whereby both main valve seats 26 and 27 must be in an open condition before fuel can flow from the inlet 22 to the outlet 24 and, thus, from the source 23 to the main burner means 25.

A first movable main valve member 28 is carried by the housing means 21 in a manner hereinafter set forth to open and close the first main valve seat 26 and a second movable main valve member 29 is movably carried by the housing means 21 to open and close the second main valve seat 27 in a manner hereinafter set forth.

The housing means 21 has a pilot valve seat 30 disposed in parallel to the first main valve seat 26 and is adapted to interconnect the inlet 22 to a pilot burner means 31, FIG. 13, when the pilot valve seat 30 is in an open condition in a manner hereinafter set forth, the pilot burner 31 being disposed adjacent the main burner 25 to ignite the main burner 25 when the pilot burner 31 has flame means in a manner hereinafter set forth.

A pilot valve member 32 is carried by the housing means 21 in a manner hereinafter set forth and is adapted to open and close the pilot valve seat 30.

The pilot valve member 32 and first main valve member 28 are carried by a lever 33 that has one end 34 pivotally mounted to the housing means 21 by a pivot pin 35 whereby the other end 36 of the lever 33 is adapted to be moved in an arcuate manner as hereinafter set forth to control the operating positions of the pilot valve member 32 and the first main valve member 28. A compression spring 37 has one end 38 bearing against the housing means 21 and the other end 39 bearing against the lever 33 to tend to pivot the lever 33 in a direction that would open the valve member 32 and 28 relative to their respective valve seats 30 and 26.

The housing means 21 carries an actuator means that is generally indicated by the reference numeral 40 and comprises a cam member 41 that has a cam surface 42 for acting on a cam follower 43 of the lever 33 in a manner hereinafter set forth to control the position of the lever 33 and, thus, the positions of the pilot valve member 32 and main valve member 28 as will be apparent hereinafter and depending upon the position of an actuator arm 44 of the actuator means 40, the arm 44 having one end 45 thereof secured to a shaft means 46 that is journaled in a suitable bearing means 47 of the housing means 21 and that has its end 48 fixed to the cam member 41 so as to rotate the cam member 41 depending upon the pivoted position of the arm 44 as will be apparent hereinafter.

Figure 7:
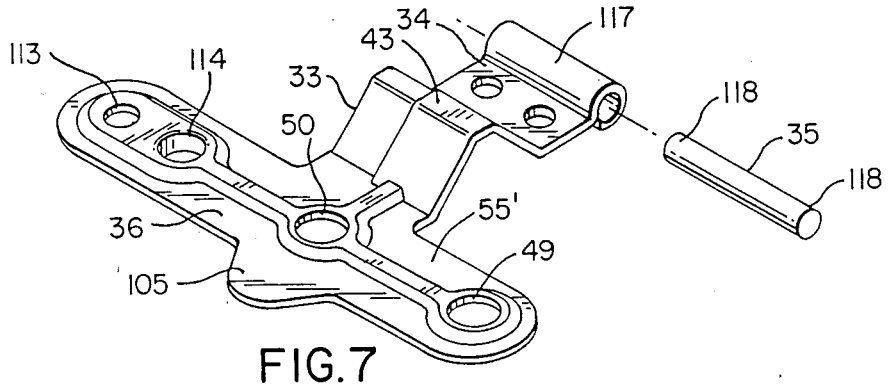
FIG. 7 is an enlarged exploded perspective view of a pivotally mounted lever means of the fuel control valve construction of this invention.
Figure 4:
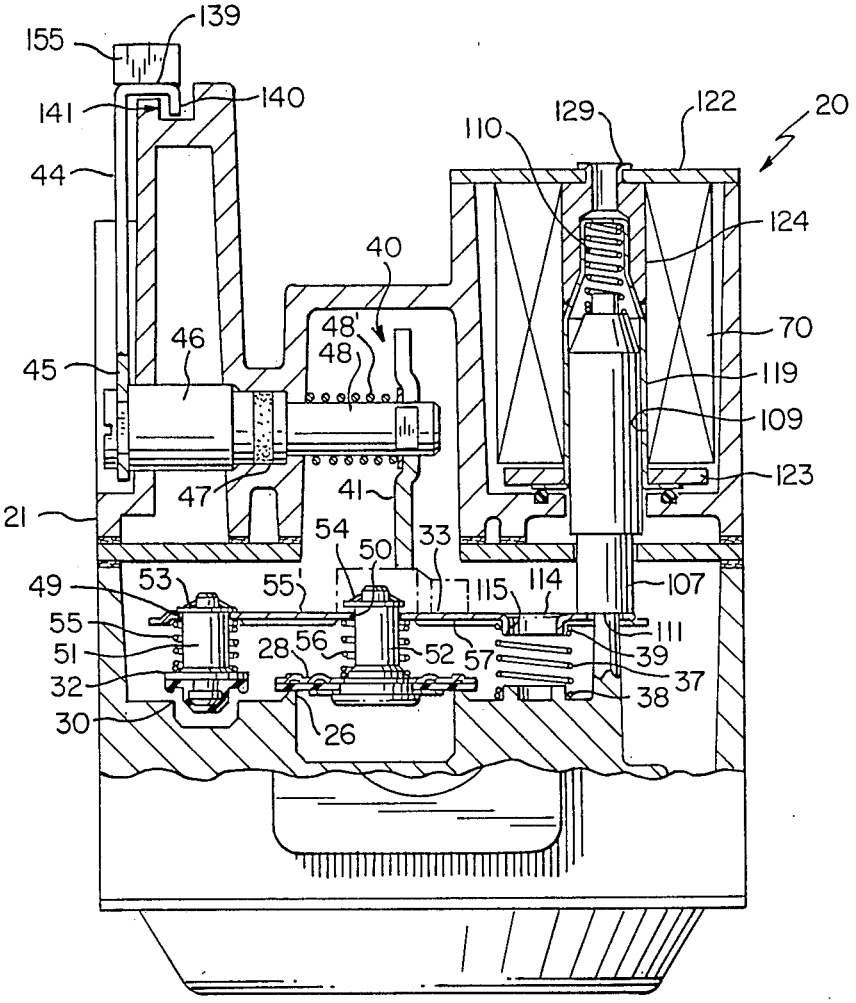
FIG. 4 is a partial cross-sectional view taken on line 4—4 of FIG. 3.

As illustrated in FIGS. 4 and 7, the end 36 of the lever 33 has a pair of openings 49 and 50 passing therethrough and respectively receiving cylindrical stems 51 and 52 of the pilot valve member 32 and first main valve member 28 therethrough, the stems 51 and 52 respectively having end retainers 53 and 54 which are larger than the openings 49 and 50 and are disposed on the side 55' of the lever 33 so as to prevent the stems 51 and 52 from being pulled out of the openings 49 and 50. The stems 51 and 52 telescopically carry compression springs 55 and 56 which respectively bear against the other side 57 of the lever 33 and the respective valve members 32 and 28 so as to tend to urge the valve members 32 and 28 away from the side 57 of the lever 33.

In this manner, the valve members 32 and 28 are axially movable relative to the lever 33 for a purpose hereinafter set forth.

The second main valve member 29 has a closed end opening 58 interrupting the side 29' thereof and receiving a stem 59 therein, the stem 59 being fixed to the housing means 21 whereby the stem 59 guides the opening and closing movement of the second main valve member 29. A compression spring 60 is telescopically disposed on the stem 59 and bears against the housing means 21 and the valve member 29 in such a manner that the force of the compression spring 60 tends to move the valve member 29 against the valve seat 27.

The opening and closing movement of the valve member 29 is controlled by a flexible diaphragm 61 that cooperates with the housing means 21 to define a chamber 62 that is adapted to be pressurized in a manner to have a central abutment 63 of the diaphragm 61 abut against the valve member 29 and move the same to an open condition in opposition to the force of the compression spring 60 in a manner fully set forth in the aforementioned U.S. patent to Kelly, U.S. Pat. No. 4,549,571 whereby this patent is being incorporated into this disclosure by this reference thereto.

Therefore, only sufficient details of the structure and operation of the diaphragm 61 for opening and closing the second main valve member 29 that is deemed necessary to understand the operation of the valve construction 20 of this invention will now be set forth as the complete details of the structure and operation can be obtained from the aforementioned U.S. patent to Kelly, U.S. Pat. No. 4,549,571.

As illustrated in FIG. 13, a chamber area 64 is disposed in the housing means 21 between the valve seats 26 and 27 and is interconnected by a passage 65 of the housing means 21 to a valve seat 66 thereof that is opened and closed by a valve member 67 that is carried on a plunger means 68 that is normally biased to a position to close the valve member 67 against the valve seat 66 by a compression spring 69, FIG. 5, in a manner hereinafter described.

Figure 5:
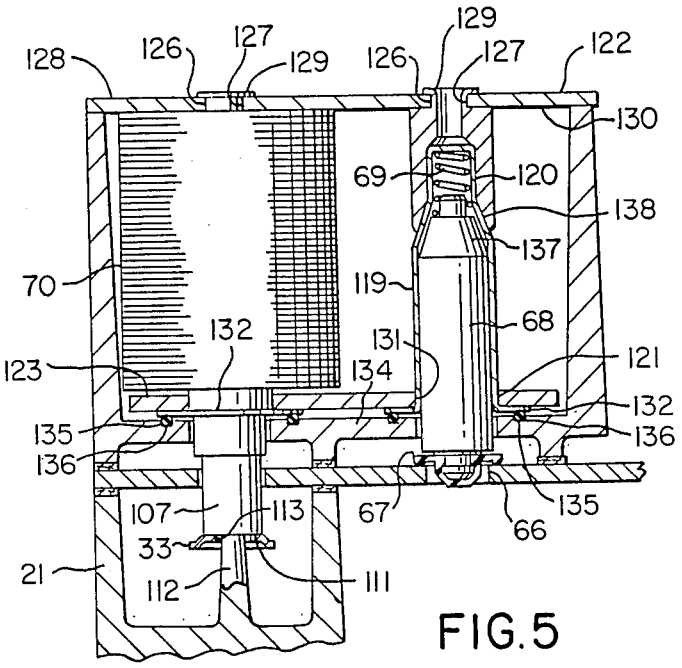
FIG. 5 is a fragmentary cross-sectional view taken on line 5—5 of FIG. 2 and illustrates the coil means and plunger means operated thereby.

However, when an electrical coil 70, FIG. 5, is energized by the closing of a thermostat 71, FIG. 13, in a manner hereinafter set forth, the plunger 68 is uniquely moved in opposition to the force of the compression spring 69 to open the valve member 67 away from the valve seat 66 and thereby interconnect the passage 65 to a housing passage 72 that leads to two orifices or restrictions 73 and 74.

The restriction 73 interconnects the passage 72 to a passage 75 of the housing means 21 that has one end 76 interconnected to the chamber 62 of the movable diaphragm 61 and the other end 77 thereof defining a bleed valve seat that is open and closed by a flexible diaphragm 78 of a pressure regulator that is generally indicated by the reference numeral 79.

The flexible diaphragm 78 of the pressure regulator 79 defines a chamber 80 with the housing means 21 that is interconnected by a passage 81 to the outlet 24 of the housing means 21, the restriction 74 interconnecting the passage 72 to the chamber 80 for a purpose hereinafter described.

Therefore, it can be seen that when the first main valve member 28 is disposed in an open condition and the valve member 66 is disposed in an open condition, fluid pressure from the inlet 22 is adapted to flow through the restriction 73 and into the passage 75 to pressurize the chamber 62 and thereby move the diaphragm 61 upwardly to engage against the valve member 29 and move the same to an open condition thereof, the pressure regulator means 79 controlling the amount of bleed from the chamber 62 out through the valve seat 77 depending upon the position of the flexible diaphragm 78 under the force of a compression spring 82 of the pressure regulator 79 in the manner fully set forth in the aforementioned U.S. patent to Kelly, U.S. Pat. No. 4,549,571.

When the valve member 67 closes against the valve seat 66, fluid pressure from the diaphragm chamber 62 is adapted to bleed out of the passage 75 through the bleed valve seat 77 until the compression spring 82 closes the diaphragm 78 against the seat 77 whereby further bleeding of the pressure from the chamber 62 takes place by the pressure flowing through the orifice 73 and then through the orifice 74 into the chamber 80, and, thus, to the outlet 24 through the passage 81 so that the valve member 29 can fully close against the valve seat 27 under the force of the compression spring 60 to terminate flow of fuel through the valve seat 27 to the outlet 24.

As illustrated in FIG. 13, the pilot valve seat 30 leads to the pilot burner 31 through a passage means 83 in the housing means 21 that includes a filter means 84 and an adjusting key 85 so that when the pilot valve member 32 is moved to an open condition thereof, fuel from the inlet 22 is adapted to flow through the filter 84 and adjusting key 85 to the pilot burner 31 to issue therefrom and be ignited by a match or the like in a manner hereinafter set forth.

An electrical circuit means 90 is adapted to be interconnected to a power source lead L2 by a lead 91 and to another power source lead L1 by a lead 92. However, the lead 92 is only interconnected to the power source lead L1 when the thermostat 71 closes against the lead 92 upon the thermostat 71 sensing that the output temperature effect of the main burner means 25 has fallen below the selected temperature of the thermostat 71 as is well known in the art.

The electrical means 90 is interconnected to the coil 70 by a lead means 93 so that electrical energy passes through the coil 70 as long as the thermostat 71 is in a closed condition thereof as will be apparent hereinafter.

A flame sensing means 87, such as a thermocouple, is provided for sensing the flame means at the pilot burner means 31. In particular, in order to make sure that gas from the inlet 22 of the valve construction 20 is not directed to the main burner means 25 unless flames are present at the pilot burner means 31, an electromagnetically operated flame sense means is carried by the housing means 21 and is generally indicated by the reference numeral 94, the flame sense means 94 comprising a coil means 95 that has current flowing through the same when the flame detector means 87 is detecting that a flame exists at the pilot burner means 31 in a manner conventional in the art. The flame sensing means 87 is interconnected to the coil 95 by the lead means 89.

Figure 3:
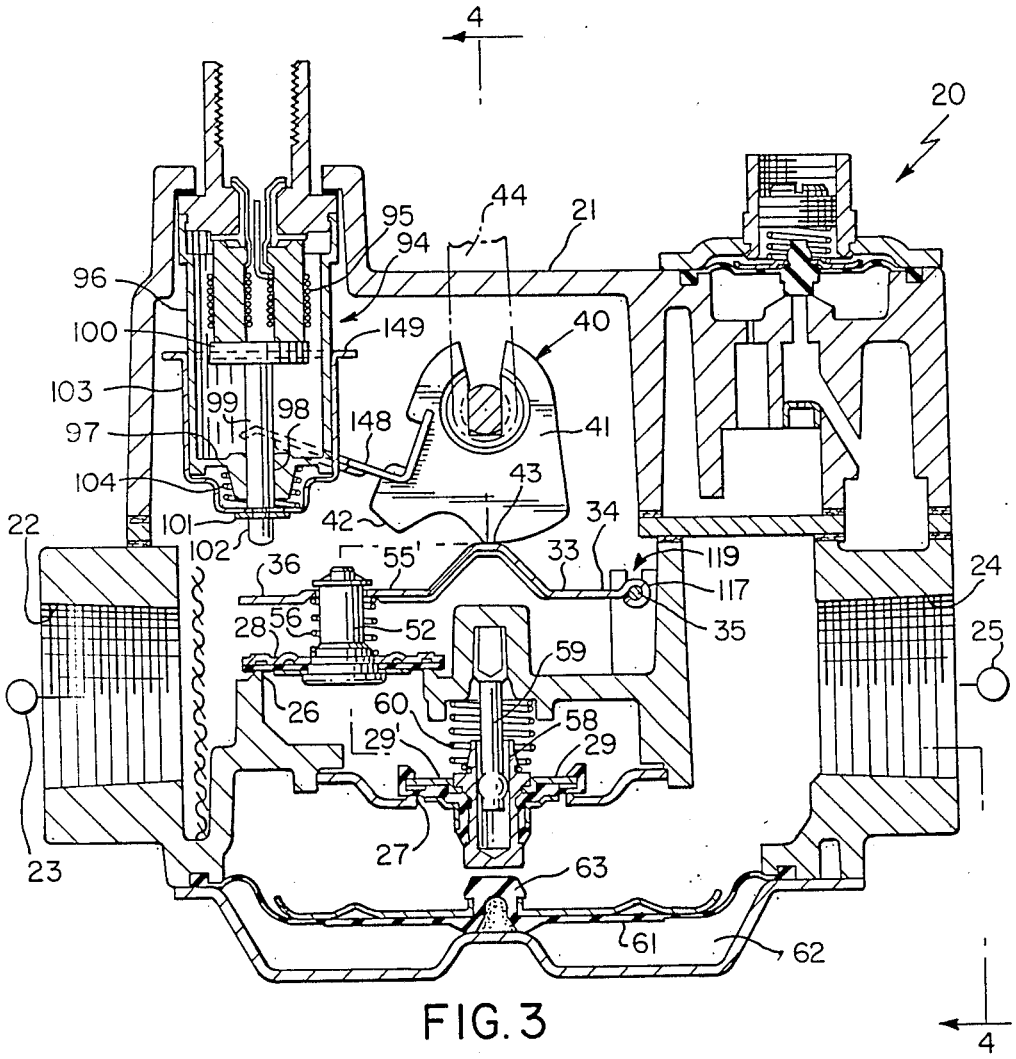
FIG. 3 is an enlarged cross-sectional view taken on line 3—3 of FIG. 1.

The flame sense means 94, as illustrated in FIG. 3, has a fixed housing 96 surrounding the coil 95 and is provided with a closed end 97 that has an opening 98 passing therethrough and through which a plunger 99 extends, the plunger 99 having an enlarged end 100 that is adapted to be magnetically locked in the position illustrated in FIG. 3 when the plunger 99 is disposed in the locked position of FIG. 3 and the coil 95 is being activated by the detector 87 detecting a flame at the pilot burner means 31.

The plunger 99 of the flame sense means 94 has a retainer 101 on the end 102 thereof and thereby secures a sleeve 103 to the plunger means 99 with the sleeve 103 telescoping the cylindrical housing 96 while being axially movable relative thereto, a compression spring 104 being disposed so as to bear against the closed end 97 of the housing 96 and against the sleeve 103 so as to tend to move the plunger means 99 downwardly relative to the coil means 95. Thus the sleeve 103 is fixed to the end 102 of the plunger means 99 so as to move in unison therewith as will be apparent hereinafter.

The end 102 of the plunger means 99 of the flame sense means 94 is adapted to engage against the end 36 of the lever 33 at its extended tip 105, FIG. 7, and move the lever 33 so that the end 36 thereof abuts against a stop 106 of the housing means in the manner illustrated in FIG. 13 wherein the lever 33 is in such a pivoted position thereof that the pilot valve member 32 and main valve member 28 are respectively urged in closed conditions against their respective valve seats 32 and 26 by the compression springs 55 and 56 as illustrated in FIG. 13.

However, when the plunger means 99 of the flame sense means 94 is locked by the coil means 95 in its locked condition as illustrated in FIGS. 3 and 14, the lever 33 is adapted to be operated by the actuator means 40 and the coil 70 in a manner hereinafter set forth.

Figure 6:
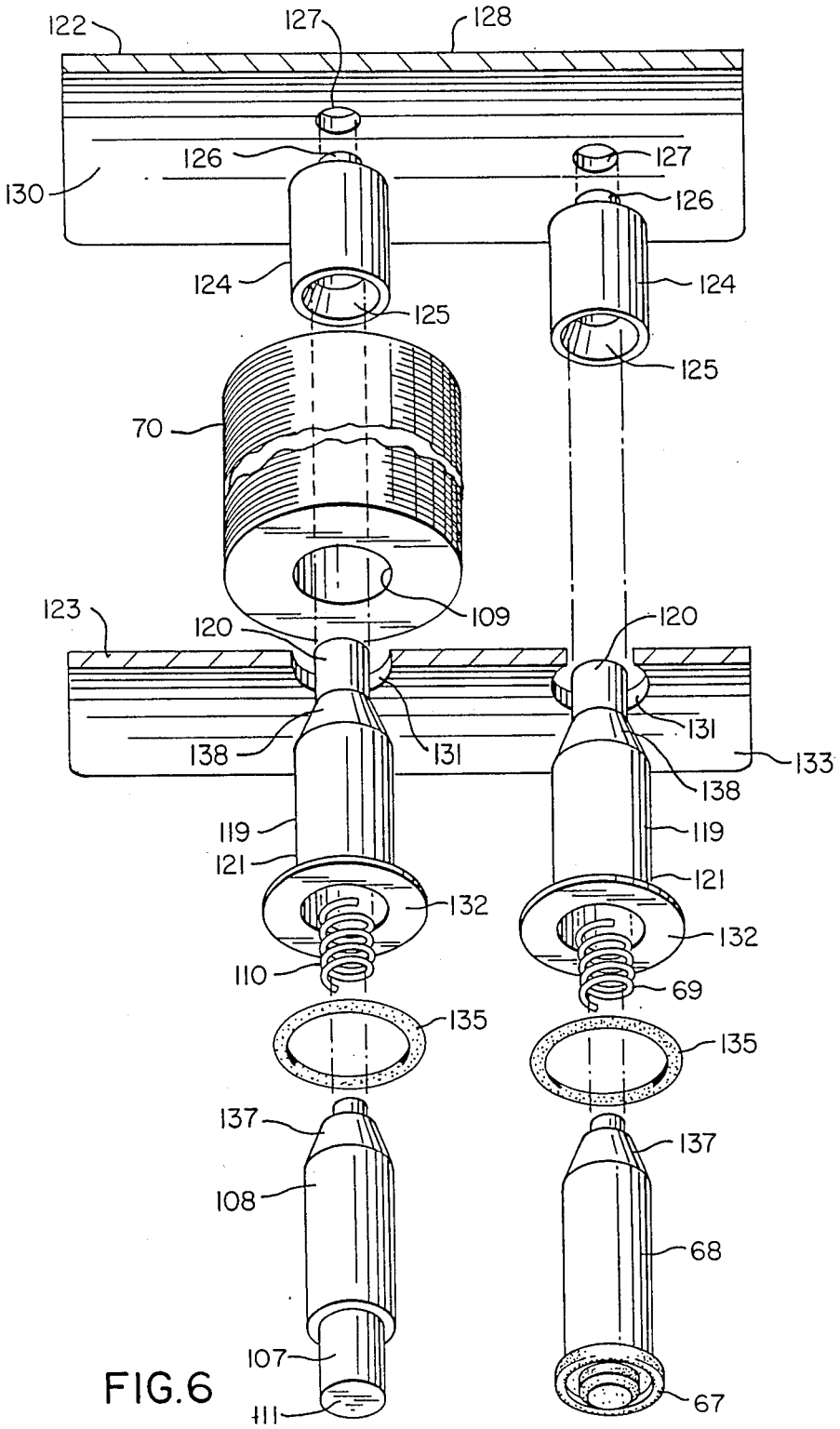
FIG. 6 is a fragmentary exploded perspective view of certain of the parts illustrated in FIG. 5.

Another movable plunger means 107 is carried by the housing means 21 and has an end portion 108, FIG. 6, disposed within the central opening 109 of the electrical coil 70 so as to be operably movable by the coil 70 when the coil 70 is energized in opposition to the force of a compression spring 110 which is similar to the compression spring 69 for the plunger 68.

The plungers 68 and 107 are both adapted to be substantially simultaneously moved upwardly in FIG. 5 in opposition to the force of the compression springs 110 and 69 when the coil 70 is energized by the thermostat 71 closing against the arm 92. However, when the thermostat 71 is in an open condition so that no electrical current flows through the coil 70, the compression springs 110 and 69 urge the plungers 107 and 68 downwardly to the position illustrated in FIG. 5 wherein the valve member 67 of the plunger 68 is disposed against the valve seat 66 to close the same and the end surface 111 of the plunger 107 is disposed against a stop 112 of the housing means 21, the plunger 107 being so constructed and arranged that the same is adapted to engage the end 36 of the lever 33 and push the same downwardly therewith so that the stop 112 passes through an opening 113 to be engaged by the end surface 111 of the plunger 107 as illustrated in FIG. 5. The stop 112 is schematically illustrated in FIG. 13 with the plunger 107 disposed against the same and it can be seen that the stop 112 is in a higher position than the stop 106 against which the lever 33 is disposed when the flame sense means 94 is in its extended condition as illustrated in FIG. 13, such further movement of the lever 33 below the stop 112 being permitted by the opening 113 of the lever 33.

However, when the flame sense means 94 has its plunger 99 moved upwardly as illustrated in FIG. 14, the compression spring 37 that acts on the end 36 of the lever 33 causes the lever 33 to move upwardly and engage against the end surface 111 of the plunger 107 as illustrated in FIGS. 4 and 5, such position of the lever 33 permitting the pilot valve member 32 to move away from its pilot valve seat 30 while maintaining the first main valve member 28 against its main valve seat 26 as illustrated in FIG. 14.

The end 36 of the lever 33 is provided with a fourth opening 114 that passes therethrough and defines a downwardly extending annular flange 115 that is received within the end 39 of the compression spring 37 as illustrated in FIG. 4 whereby the annular flange 115 acts as a spring retainer for the compression spring 37.

The end 34 of the lever 33 defines a cylindrical structure 117 through which the pivot pin 35 extends so that the opposed ends 118 of the pin 35 extend beyond the cylindrical structure 117 of the lever 33 and can be received in suitable notches 119 of the housing means 21 so as to hold the pivot pin 35 in place and permit the lever 33 to pivot on the pin 35 to position the lever 33 as will be apparent hereinafter.

Referring now to FIGS. 5 and 6, it can be seen that the single coil 70 that operates the two plunger means 68 and 107 in substantially a simultaneous manner is arranged so that the flux created by the energized coil 70 not only draws the plunger 107 upwardly into the opening 109 thereof in the same manner as an armature, but also such flux created by the energized coil 70 is sufficient to draw the plunger 68 upwardly into an open ended cylindrical member 119 that has a closed end 120 and an open end 121. A similar cylindrical member 119 is provided for the plunger means 107 as will be apparent hereinafter.

A pair of mounting plates 122 and 123 are provided for the housing means 21 and are respectively spaced from each other by the sleeves 119 cooperating with a pair of pole pieces 124 respectively secured to the plate 122 and having the closed ends 120 of the sleeves 119 disposed in the open ends 125 thereof as illustrated in FIGS. 5 and 6.

The pole pieces 124 have reduced cylindrical portions 126 respectively passing through openings 127 in the plate 122 to be turned over against the side 128 thereof to define rivet-like structures 129 securing the pole pieces 124 to the plate 122 so that the pole pieces 124 extend from the other side 130 of the plate 122 toward the plate 123.

The sleeves 119 respectively pass through suitable openings 131 in the plate 123 and have outwardly directed annular flanges 132 thereof at the open ends 121 thereof abutting against the under side 133 of the plate 123 when the same have their ends 120 fully received in the pole pieces 124 as illustrated in FIG. 5, the annular flanges 132 of the sleeves 119 being secured to the side 133 of the plate 123 in any suitable manner, such as by brazing, etc.

The plate 123 has its side 133 sealed to a substantially flat surface 134 of the housing means 21 by suitable annular 0-ring sealing members 135 respectively disposed in annular grooves 136 in the surface 134 as illustrated in FIG. 5.

Figure 17:
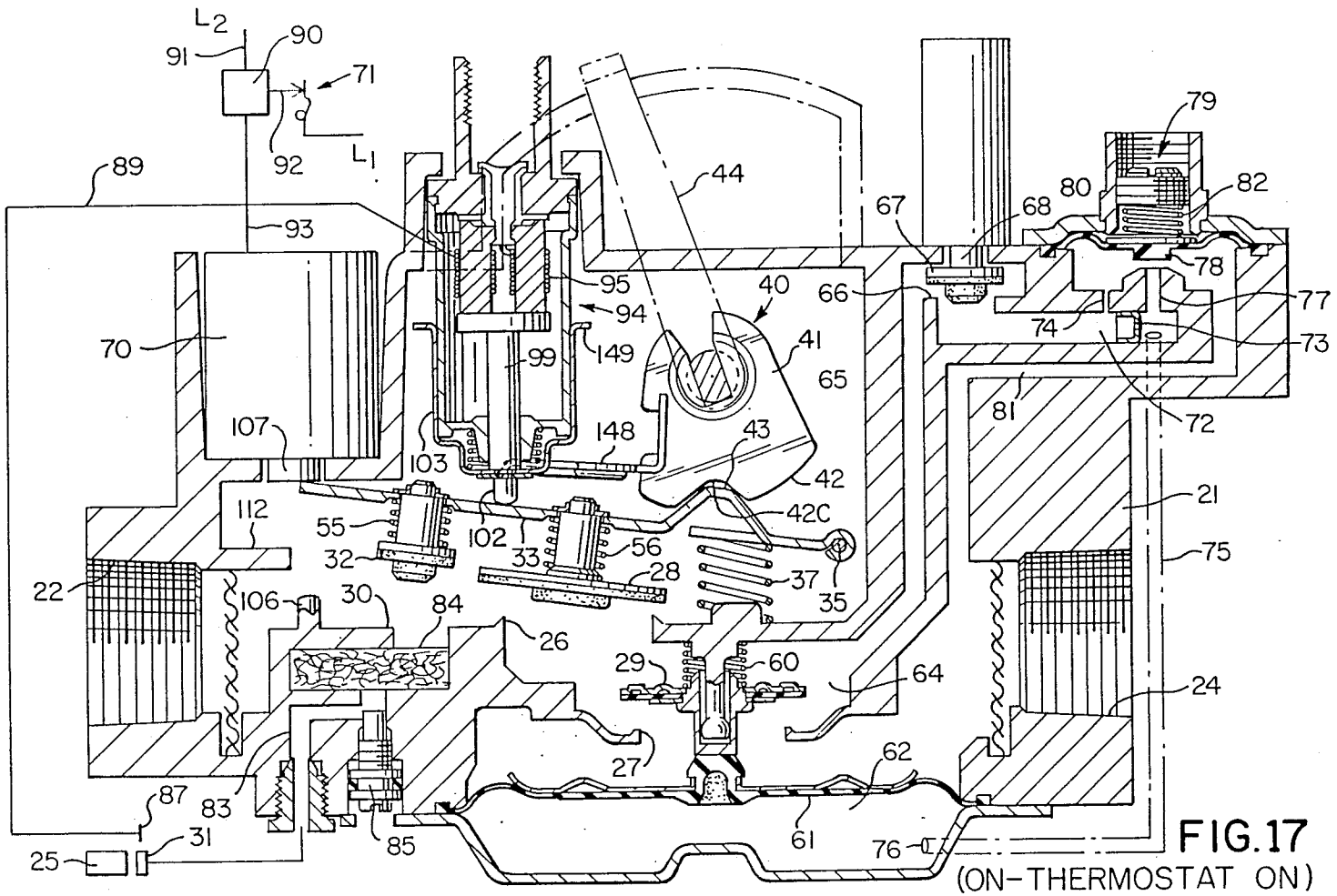
FIG. 17 is a view similar to FIG. 13 and illustrates the actuator means in the "on" position thereof and the thermostatic means in the "on" condition thereof.

In this manner it can be seen that by forming the plates 122 and 123, pole pieces 124, cylindrical members 119 and plungers 68 and 107 of suitable metallic material, the flowing of an electrical current through the coil 70 in a manner well known in the art will cause the plungers 107 and 68 to each be drawn upwardly in FIG. 5 in opposition to the force of the compression springs 110 and 69 until the frusto-conical ends 137 of the plungers 68 and 107 engage against cooperating frusto-conical sections 138 of the cylindrical members 119 to prevent further upward movement thereof. However, such upward movement of the plunger 68 is sufficient to open the valve member 67 away from the valve seat 66 and such upward movement of the plunger 107 is sufficient to permit the lever 33 to be movable to the fully "on" position of the lever 33 as illustrated in FIG. 17 to cause both the pilot valve member 32 and first main valve member 28 to be disposed completely away from their valve seats 30 and 26 for a purpose hereinafter set forth.

Also, it is believed that the coil 70 and plungers 107 and 68 can be so constructed and arranged that the plunger 107 will be pulled in by the energized coil 70 slightly before the plunger 68 opens the valve member 67 away from the valve seat 66 if desired.

For further details of the general structure and operation of an electrical coil and its associated armature or plunger see the U.S. patent to Katchka et al, U.S. Pat. No. 4,142,169 whereby this patent is being incorporated into this disclosure by this reference thereto.

The arm 44 of the actuator means 40 has its upper end 139 bent into a U-shape to define a downwardly depending tang 140 which is received in substantially a straight line slot 141 formed in the housing means 21 whereby the slot 141 guides the pivoting movement of the arm 44. However, a pair of abutments 142 and 143 are respectively provided in the slot 141 with the abutments 142 and 143 respectively having tapered surfaces 144 and 145 and flat end surfaces 146 and 147 respectively disposed in the normal path of movement of the tang 140 of the arm 44. The arm 44 is sufficiently resilient so that the same can be pushed to the right in FIG. 4 or pulled to the left in FIG. 4 and the natural resiliency of the arm 44 will return the tang 140 to approximately the center of the slot 141 when the pushing and/or pulling force thereon is removed.

Figure 12:
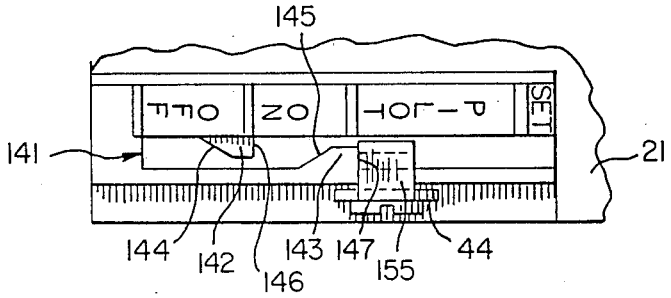
FIG. 12 is a fragmentary view of the actuator arm arrangement and is taken in the direction of the arrows 12—12 of FIG. 11.
Figure 11:
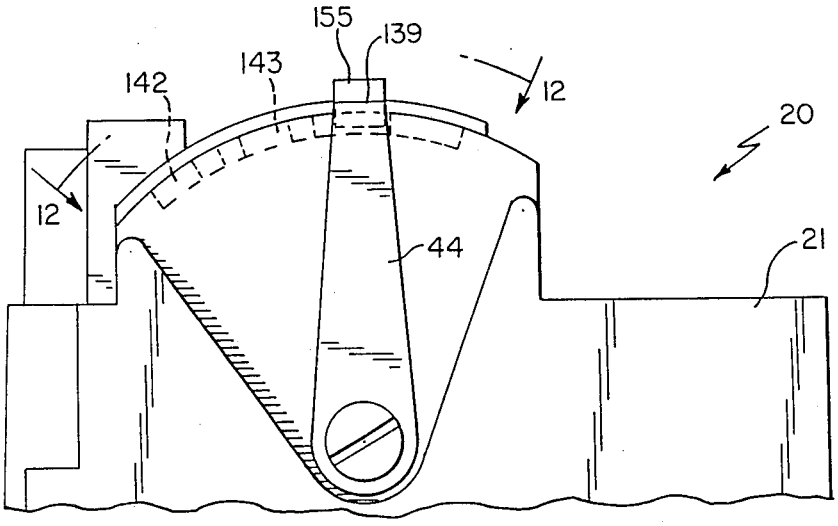
FIG. 11 is an enlarged fragmentary end view of the fuel control valve construction of FIG. 1 and illustrates the actuating arm thereof.

Thus, it can be seen in FIG. 12 that when the tang 140 of the arm 44 is disposed in the "off" position, the tang 140 can be readily pushed directly to the "set" position as the tang 140 will first engage against the slanting surface 144 of the abutment 142 and thereby be pushed downwardly in FIG. 12 to clear the abutment 142 and then will engage against the slanting surface 145 of the abutment 143 so as to be pushed upwardly in FIG. 12 to clear the abutment 143 whereby the tang 140 will be received in the "pilot" area as illustrated in full lines in FIG. 12 and can be directly pushed to the right to the "set" position for pilot lighting purposes as will be apparent hereinafter.

However, a coiled torsion spring 48′ is telescopically disposed on the end 48 of the shaft means 46 and has one end interconnected to the housing means 21 and the other end interconnected to the shaft means 46 so that such spring 48′ is wound up when the arm 44 is moved from the "pilot" position thereof to the "set" position thereof. In this manner, the spring 48′ will return the arm 44 from the "set" position thereof against the stop surface 147 of the stop 143 at the "pilot" position thereof with sufficient force when the operator releases the lever 44 after the same was being held in the "set" position thereof for pilot lighting purposes as will be apparent hereinafter.

In order to return the arm 44 from the "pilot" position to the "on" position the operator must push upwardly on the arm 44 from the position illustrated in FIG. 12 in order to have the tang 140 clear the stop abutment surface 147 and thereby permit the tang 140 to be moved from the "pilot" position to the "on" position. However, with the arm 44 pushed upwardly in FIG. 12, it will be seen that the tang 140 will engage against the abutment surface 146 of the abutment 142 and cannot then be pushed directly to the "off" position as the arm 44 must now be pulled downwardly in FIG. 12 in order to have the tang 140 clear the surface 146 to be then pushed into an "off" position.

Therefore, the operator will directly move the arm 44 from the "off" position to the "set" position without realizing the effect of the abutments 142 and 143. However, in order to return the arm 44 from the "pilot" position to the "off" position, the operator must first push upwardly on the arm in FIG. 12 to get to the "on" position and then pull downwardly on the arm 44 in order to move the arm 44 from the "on" position to the "off" position.

Of course, the above described substantially straight line pivoting movement of the arm 44 to the various positions illustrated in FIG. 12 causes the cam member 41 to assume the various positions illustrated in FIGS. 13, 14, 15 and 16.

When the arm 44 is being moved from the "off" position of FIG. 13 to the "set" position of FIG. 14, it can be seen that a yoke member 148 that is carried by the cam member 41 engages against an outwardly directed annular flange 149 on the cylindrical sleeve 103 of the flame sense means 94 and moves the same upwardly from the position illustrated in FIG. 13 to the position illustrated in FIG. 14 in opposition to the force of the compression spring 104 so as to dispose the enlarged end 100 of the plunger 99 in its locked position adjacent the coil 95 of the flame sense means 94 for a purpose hereinafter described.

Figure 18:
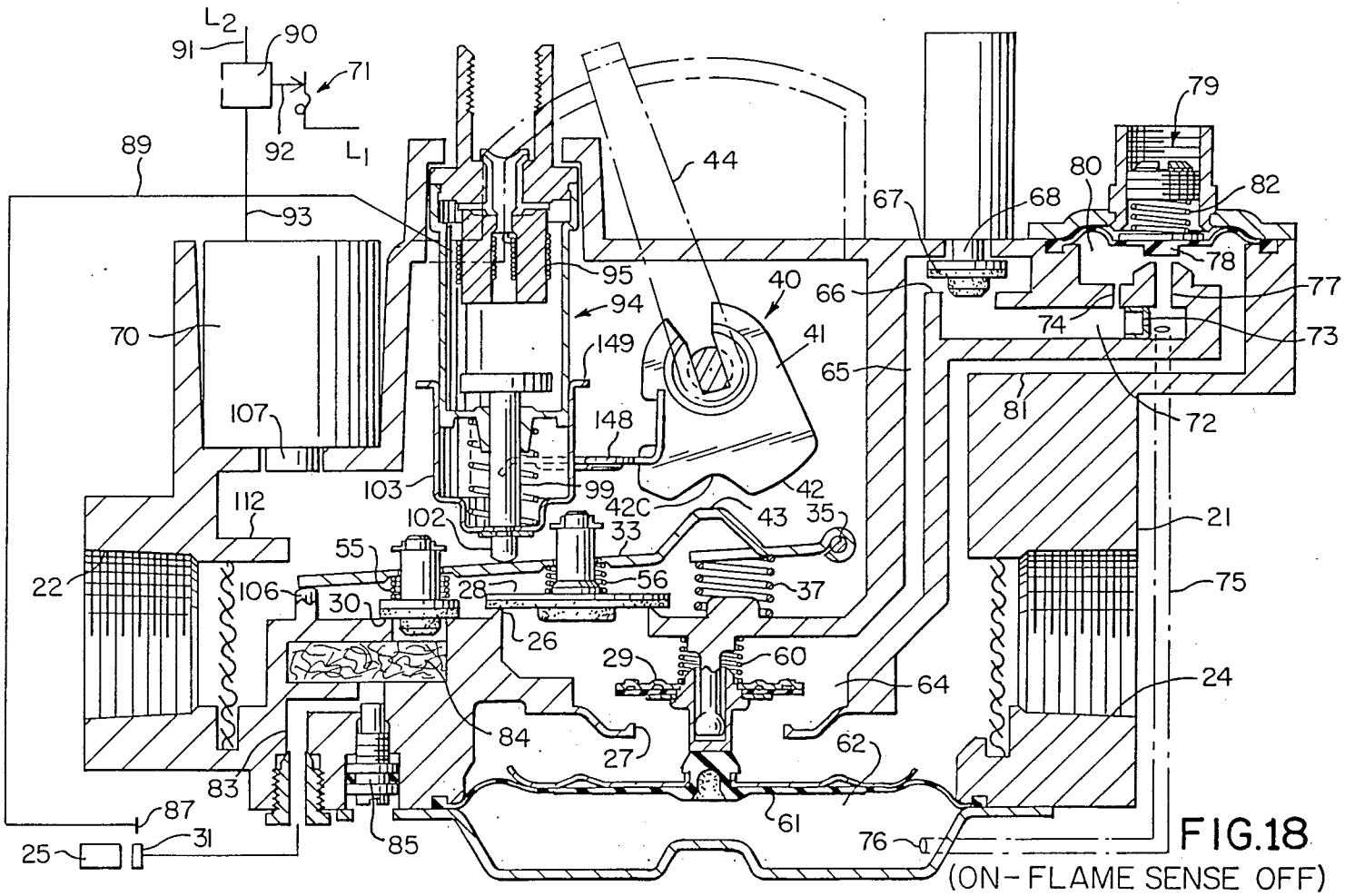
FIG. 18 is a view similar to FIG. 13 and illustrates the actuator means in the "on" position thereof and the flame sense means in the "off" condition thereof.

When the arm 44 is moved from the "set" position of FIG. 14, to the "pilot" position of FIG. 15, it can be seen that the yoke member 148 is moved away from the flange 149 of the flame sense means 94 so that should the coil 95 not be operating to hold the plunger 99 in its locked position, the spring 104 will drive the plunger 99 downwardly to the position illustrated in FIG. 18 and thereby hold the lever 33 against the stop 106 so that the pilot valve member 32 and the first main valve member 28 are in their closed conditions against the respective valve seats 30 and 26 for a purpose hereinafter set forth.

Figure 8:
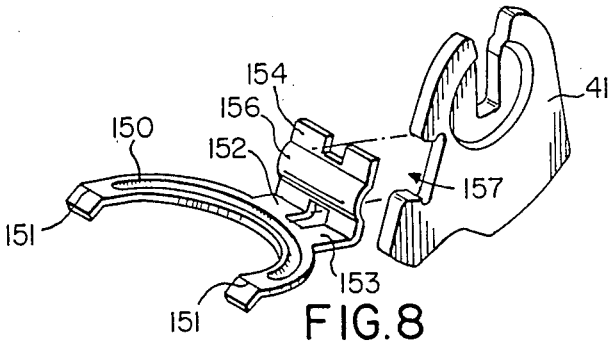
FIG. 8 is an exploded perspective view of part of the actuator means of the fuel control valve construction of this invention.
Figure 9:
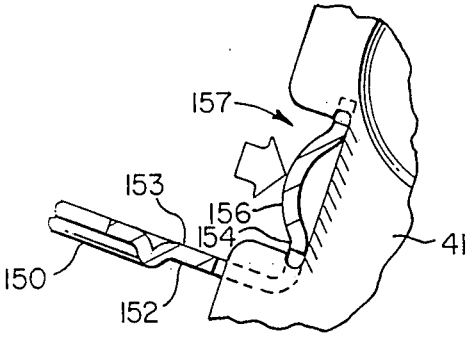
FIG. 9 is an enlarged fragmentary view, partially in cross section, illustrating one step in the method of assembling together the parts of FIG. 8.
Figure 10:
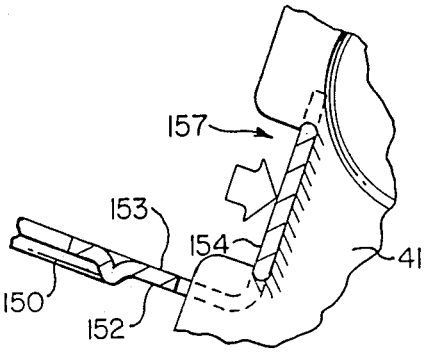
FIG. 10 is a view similar to FIG. 9 and illustrates the final step in the method of assembling together the parts of FIG. 8.

The yoke member 148 is best illustrated in FIG. 8 and has a U-shaped part 150 provided with bent tang ends 151 which respectively are adapted to engage against the underside of the annular flange 149 of the sleeve 103 of the flame sense means 94 as previously described. The yoke member 148 can be formed of any suitable metallic material and the same has an L-shaped part 152 with the leg 153 thereof formed integrally with the U-shaped part 150 and the other leg 154 thereof being bifurcated to define a slot 154'therein, the leg 154 normally having an arcuate section 156 that permits the leg 154 to be disposed in a slot 157 of the cam member 41 as illustrated in FIG. 9 and thereafter have the bowed portion 154 flattened as illustrated in FIG. 10 to firmly lock the leg 154 to the cam member 41 so that the yoke member 148 moves in unison with the cam member 41 for the purpose previously described.

If desired, the arm 44 of the actuator means 40 can have a suitable push/pull handle 155 on the end 139 thereof to facilitate the movement of the arm 44 as previously described.

Figure 19:
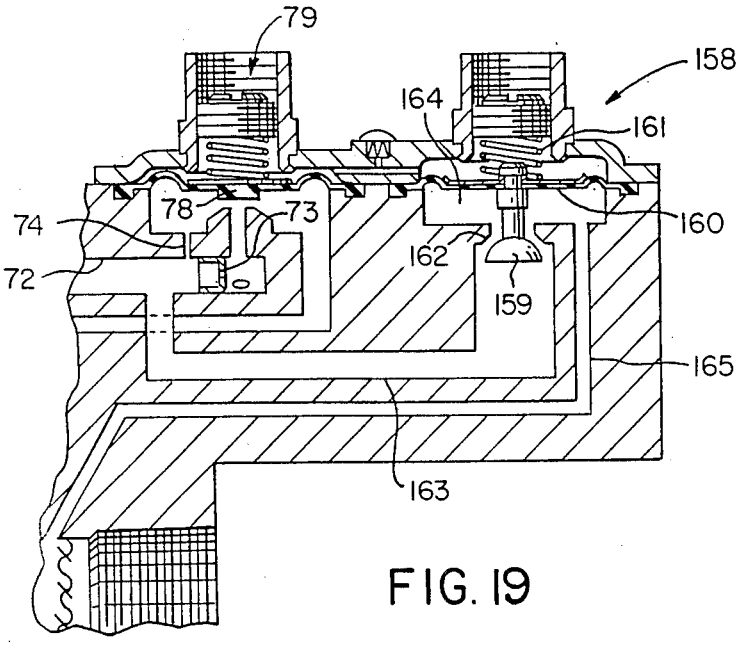
FIG. 19 is a fragmentary schematic view similar to FIG. 13 and illustrates another embodiment of this invention.

Should it be desired to provide the valve construction 21 with means for providing a soft ignition at the main burner means 25 such as by providing a low flow of fuel to the burner means 25 that is less than a full rated flow of fuel but is sufficient by itself to support combustion at the burner means 25 each time the thermostat 71 closes, the fuel control valve construction 20 can be provided with a bypass regulator means that is generally indicated by the reference numeral 158 in FIG. 19 in the same manner as the fuel control valve construction set forth in the aforementioned U.S. patent to Kelly, U.S. Pat. No. 4,549,571.

In particular, the pressure regulator means 158 includes a movable valve member 159 carried by a flexible diaphragm 160 and normally urged to a valve member opening position by a compression spring 161 whereby the valve member 159 is disposed away from a valve seat 162 of the housing means 21. The valve seat 162 is interconnected to the passage 72 in advance of the restriction means 73 and 74 by a bypass passage 163. The valve seat 162 is adapted to interconnect the passage 163 with a chamber 164 defined by the diaphragm 160 and the housing means 21, the chamber 164 in turn being interconnected to the outlet 24 by a passage 165.

In addition to the bypass regulator 158 being provided in FIG. 19, the passage 75 that leads to the main diaphragm chamber 62 is provided with a delay means therein (not shown) that slows down the pressurization of the chamber and, thus, the opening of the main valve member 29 until after the bypass means 163 has provided a soft ignition at the main burner means 25 whereby the subsequent opening of the main valve member 29 provides a full rate of flow of fuel to the burner means 25 in the manner previously described and as fully set forth in the aforementioned patent to Kelly, U.S. Pat. No. 4,549,571.

From the above, it can be seen that the control device 21 of this invention can be made from the various parts thereof in a simple manner by the method of this invention to operate in a manner now to be described.

As illustrated in FIG. 13, the actuator arm 44 is disposed in its "off" condition wherein the part 42A of the cam surface 42 of the cam member 41 is acting on the cam follower portion 43 of the lever 33 and has moved the lever 33 in a counterclockwise direction in FIG. 13 in opposition to the force of the compression spring 37 so that the pilot valve member 32 and main valve member 28 are respectively held in closed conditions against their respective valve seats 30 and 26 so that no fuel from the inlet 22 can flow to the pilot burner means 31 or to the main burner means 25. In addition, it can be seen that the control device 20 in FIG. 13 is in a condition wherein the thermostat 71 is in a satisfied condition thereof so that the coil 70 is in a deenergized condition thereof and the plunger means 108 and 68 are respectively urged downwardly by their respective compression springs 110 and 69 so that the plunger 107 is against the stop 112 and the plunger 68 has its valve member 67 held against the valve seat 66. In addition, since no flame exists at the pilot burner means 31, the flame detector 87 maintains the coil 95 in its deenergized condition so that the compression spring 104 of the flame sense means 94 holds the plunger 99 against the lever 33 to maintain the same against the stop 106 as illustrated.

When the operator desires to initially turn on the furnace utilizing the fuel control valve construction 20 of this invention by lighting the pilot burner 31, the operator must first move the actuator arm 44 to its "set," "reset" or "pilot light" position as illustrated in FIG. 14 wherein the cam member 41 now has the part 42B of the cam surface 42 thereof acting on the follower portion 43 of the lever 33 so that the lever 33 can pivot in a clockwise direction under the force of the compression spring 37 to the position illustrated in FIG. 14 wherein the end 36 of the lever 33 is disposed against the end surface 111 of the plunger means 107. In such position of the lever 33, the pilot valve member 32 has been moved away from its valve seat 30 while the main valve member 28 is still maintained in contact with its valve seat 26. Of course, should the thermostat 71 be demanding heat at the time the arm 44 is moved to the "set" position as illustrated in FIG. 14, the cam surface 42B of the cam member 41 will maintain the lever 33 in the pivoted condition illustrated in FIG. 14 so that if the electrical circuit means 90 interconnects the power source leads L1 and L2 to the coil means 70, the upward movement of the plunger means 107 and 68 still will not affect the position of the lever 33 from remaining in the position illustrated in FIG. 14 until the arm 44 of the actuator means 40 of the valve construction 20 is moved out of its "pilot" position. However, the circuit means 90 may be so constructed and arranged that the same will not interconnect the power source leads L1 and L2 to the coil means 70 even though the thermostat 71 is in its closed condition until the sense means 87 is detecting a flame at the pilot burner means 31.

It can be seen that when the arm 44 of the actuator means 40 is being moved from its "off" position to the "set" position of FIG. 14, the yoke member 148 has its tang ends 151 engage against the annular flange 149 of the sleeve 103 of the flame sense means 94 and move the same upwardly from the position illustrated in FIG. 13 to the position illustrated in FIG. 14 in opposition to the force of the compression spring 104 so that the enlarged end 100 of the plunger 99 is placed in its locking position relative to the coil 95, the yoke member 148 holding the plunger 99 in such locking position thereof as long as the arm 44 of the actuator means 40 is in its "set" position.

When the arm 44 of the actuator means 40 is in its "set" position, the gas now issuing from the pilot burner means 31 can now be ignited by the operator utilizing a match or the like.

In any event, once the flame exists at the pilot burner means 31, the detector means 87 detects the presence of such flame and thereby causes a current to flow through the coil 95 of the flame sense means 94 so that the flame sense means 94, through an electromagnetic flux condition, maintains the plunger 99 in its locked position as illustrated in FIG. 14.

At this time, the operator can return the arm 44 to the "pilot" position, either manually or by the return spring 48', as illustrated in FIG. 15 where the tang 140 is against the stop 143. In this position, the cam part 42B of the cam surface 42 is still acting on the follower portion 43 of the lever 33 so that the pilot valve member 32 remains open. However, the yoke member 148 has now been moved away from the flange 149 of the flame sense means 94 a sufficient distance so that if the flame at the pilot burner 31 ceases to exist or did not exist in the first place through an unsuccessful pilot lighting attempt, the plunger 99 will be driven downwardly by the spring 104 to pivot the lever 33 against the stop 106 and thereby close the pilot valve member 32 against its valve seat 30 to stop any further flow of fuel through the pilot burner 31.

Figure 16:
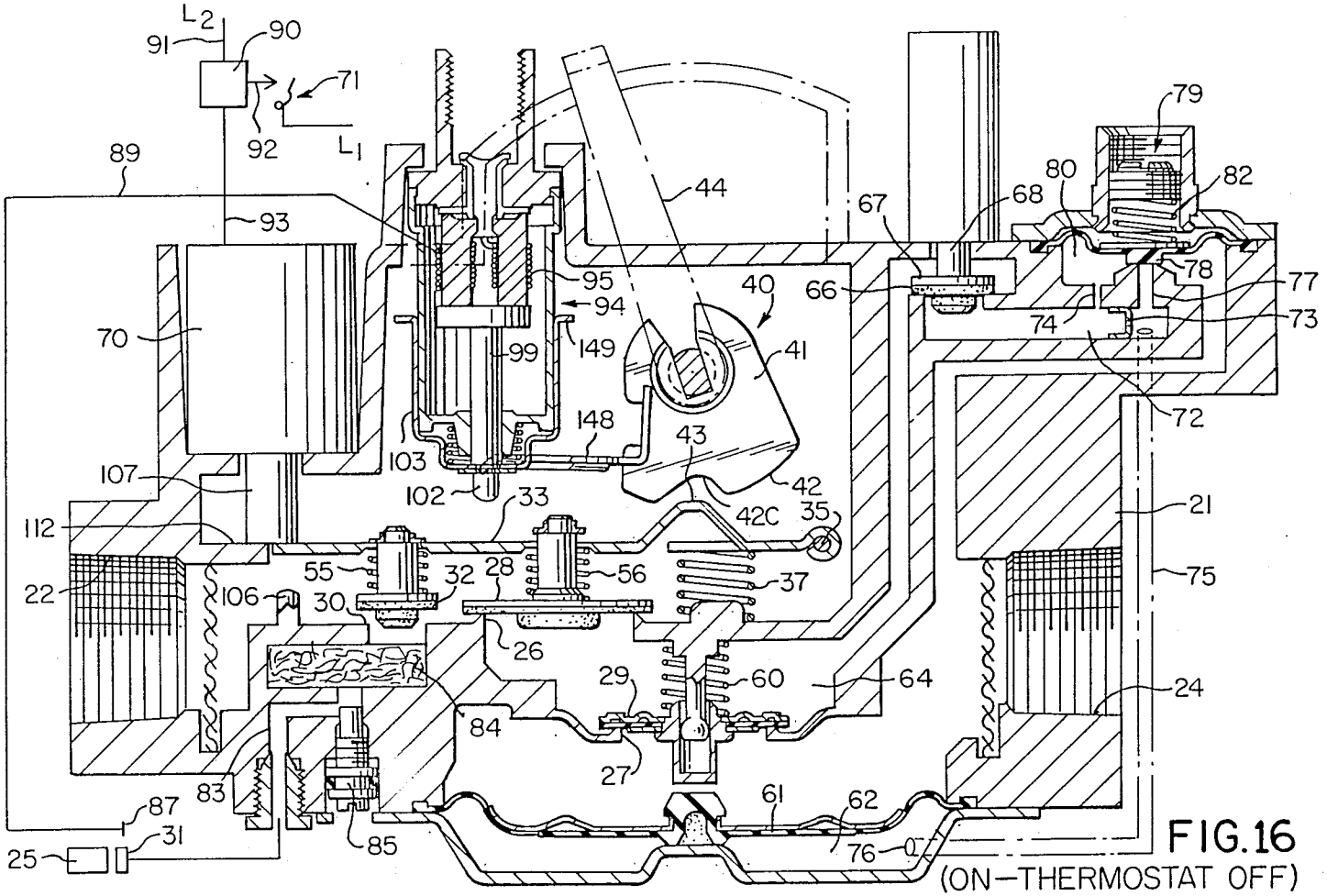
FIG. 16 is a view similar to FIG. 13 and illustrates the actuator means in the "on" position thereof while the thermostatic means is in the "off" condition thereof.

In the normal situation where the flame now exists at the pilot burner means 31 so that the flame sense means 94 is locked in its up condition as illustrated in FIG. 15, the operator can move the arm 44 of the actuator means 40 to its "on" position as illustrated in FIG. 16 where the cam surface 42C of the cam member 41 is now adjacent the follower means 43 of the lever 33 so that the compression spring 37 would tend to further rotate the lever 33 in a clockwise direction to position the cam follower 43 of the lever 33 against the cam surface 42C of the cam 41. However, if at this time the thermostat 71 is still in an open condition, it can be seen that the lever 33 cannot follow the permitted clockwise movement thereof from the position illustrated in FIG. 16 to place the cam follower means 43 into the cam surface 42C of the cam 41 because the end 36 of the lever 33 is still disposed against the end surface 111 of the plunger 107 that holds the lever 33 in the condition of maintaining the first main valve member 28 against its valve seat 26 to prevent any flow of fuel to the outlet 24.

However, when the thermostat 71 determines that the main burner means 25 should be operating in order to supply heat, the thermostat 71 is in the closed condition as illustrated in FIG. 17 whereby the same energizes the coil 70 which substantially simultaneously moves the plunger means 107 and 68 upwardly so as to permit the lever 33 to pivot in a clockwise direction and the valve member 67 to be moved away from the valve seat 66.

At this time, the lever 33 carries the main valve member 28 away from the valve seat 26 so that fuel can now flow to the space 64 intermediate the valve members 28 and 29 and be passed through the passage 65, now open valve seat 66 and restrictor 73 into the passage 75 to the diaphragm chamber 62. As the pressure builds up in the diaphragm chamber 62, the pressure moves the diaphragm 61 upwardly and thereby carries the valve member 29 upwardly therewith in opposition to the force of the compression spring 60 so that the valve member 29 can now move to its open condition as illustrated in FIG. 17 and permit fuel to now flow from the inlet 22, opened valve seats 26 and 27 to the outlet 24 and thereby issue from the main burner means 25 to be ignited by the pilot burner means 31. The pressure regulator 79 now functions in a manner to maintain the output pressure of the fuel being supplied to the burner means 25 at a substantially constant rate as determined by the setting of the pressure regulator 79 in the manner fully set forth in the aforementioned U.S. patent to Kelly, U.S. Pat. No. 4,459,571. Thus, the fuel control valve construction 20 of this invention remains in the condition illustrated in FIG. 17 as long as the thermostat 71 remains in the closed condition and thereby demands heat from the main burner means 25.

However, when the thermostat 71 is now satisfied, the thermostat 71 opens and thereby disconnects electrical energy from the coil 70 so that the deenergized coil 70 permits the plunger means 107 and 68 to be moved downwardly by their respective compression springs 110 and 69. The downwardly moving plunger 107 carries the lever 33 therewith to the position illustrated in FIG. 15 so that the lever 33 closes the valve member 28 against the valve seat 26 to terminate the flow of fuel to the outlet means 24 and, thus, to the main burner means 25. In addition, the valve member 67 of the plunger means 68 is moved against its valve seat 66 to terminate the flow of fuel to the diaphragm chamber 62 which now exhausts to the outlet 24 in the manner previously described through the bleed valve seat 77 and then through the orifices 73 and 74 so that the exhausted chamber 62 permits the diaphragm 61 to be moved downwardly by the force of the compression spring 60 and thereby have the valve member 29 close against the valve seat 27.

At this time, the position of the lever 33 maintains the pilot valve member 32 in an open condition relative to its seat 30 so that the flame continues to exist at the pilot burner means 31.

Subsequently, should the thermostat 71 again close and thereby demand heat from the main burner means 25, the closing of the thermostat 71 energizes the coil 70 so that the plungers 107 and 68 are again moved upwardly from their down positions to the positions illustrated in FIG. 17 to cause the valve members 28 and 67 to open and, thus, the valve member 29 to subsequently open in the manner previously set forth to again supply fuel to the main burner means 25.

Thus, the fuel control valve construction 20 of this invention will cycle the main burner means 25 on and off under the control of the thermostat 71 as long as the arm 44 of the actuator means 40 remains in its "on" condition and as long as a flame exists at the pilot burner means 31.

While the arm 44 of the actuator means 40 of the valve construction 20 is in the "on" condition thereof and if for some reason the flame at the pilot burner means 31 should cease to exist, the detector 87 no longer will generate a current flow through the coil 95 of the flame sense means 94 and the coil means 95 will thereby release the plunger 99 which under the force of the compression spring 104 will be driven downwardly in the manner illustrated in FIG. 18 to force the lever 33 against the stop 106 and thereby close the pilot valve member 32 against its valve seat 30 and the first main valve member 28 against its valve seat 26 and thereby terminate not only the flow of fuel to the main burner means 25, but also to the pilot burner means 31.

Thus, under the conditions illustrated in FIG. 18 and even though the thermostat 71 is demanding heat, it can be seen that no fuel will flow to the burner means 31 and 25 whereby in order to relight the pilot burner means 31, the arm 44 of the actuator means 40 must be returned to the "set" position so that the control valve means 20 can be operated in the manner previously set forth.

As previously stated, should it be desired to provide a soft ignition of the burner means 25 each time the second main valve member 29 is opened relative to its seat 27, the fuel control valve construction 20 can utilize the bypass pressure regulator means 158 of FIG. 19 in the same manner as set forth in the aforementioned U.S. patent to Kelly, U.S. Pat. No. 4,549,571 whereby a further description of such soft ignition operation is not necessary.

From the above, it can be seen that the fuel control valve construction 20 of this invention operates in a simple and effective manner to control the operation of the burner means 31 and 25 as previously set forth.

Thus, it can be seen that this invention not only provides a new fuel control valve construction and method of making the same but also this invention provides new parts for such a valve construction and methods of making such new parts.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In the combination comprising a supporting means, electrically operated coil means carried by said supporting means, two movable plunger means carried by said supporting means in generally a side-by-side spaced apart parallel relation and being operatively associated with said coil means to be moved to certain positions thereof when said coil means is energized, and two separate valve means carried by said supporting means and respectively being operatively associated with said plunger means to be controlled thereby, the improvement wherein said coil means comprises a single coil having a portion of one of said plunger means disposed therein, the other of said plunger means being entirely external to said coil while being adapted to be operated by said coil substantially in unison with said one plunger means.

2. A combination as set forth in claim 1 and further comprising spring means carried by said supporting means and tending to move said two plunger means to certain other positions thereof.

3. A combination as set forth in claim 1 wherein each said plunger means comprises a movable plunger and a stationary pole piece for that said plunger and that causes that said plunger to be moved to its said certain position only when the flux created by said coil means being energized is imposed thereon.

4. A combination as set forth in claim 1 wherein each valve means comprises a valve seat and a movable valve member for opening and closing said valve seat, said single coil causing said valve members to move to open positions thereof relative to their respective valve seats when said coil is energized.

5. In a method of making the combination comprising a supporting means, electrically operated coil means carried by said supporting means, two movable plunger means carried by said supporting means in generally a side-by-side spaced apart parallel relation and being operatively associated with said coil means to be moved to certain positions thereof when said coil means is energized, and two separate valve means to be carried by said supporting means and respectively be operatively associated with said plunger means to be controlled thereby, the improvement comprising the steps of forming said coil means to comprise a single coil having a portion of one of said plunger means disposed therein, and disposing the other of said plunger means so as to be entirely external to said coil while being adapted to be operated by said coil substantially in unison with said one plunger means.

6. A method as set forth in claim 5 and including the step of disposing spring means to be carried by said supporting means and tend to move said two plunger means to certain other positions thereof.

7. A method as set forth in claim 5 and including the steps of forming each said other plunger means to comprise a movable plunger and a stationary pole piece for that said plunger and that causes that said plunger to be moved to its said certain position only when the flux created by said coil means being energized is imposed thereon.

8. A method as set forth in claim 5 and including the steps of forming each valve means to comprise a valve seat and a movable valve member for opening and closing said valve seat, and disposing said single coil to cause said valve members to move to open positions thereof relative to their respective valve seats when said coil is energized.

* * * * *